US012349798B2

(12) United States Patent
Staudacher

(10) Patent No.: US 12,349,798 B2
(45) Date of Patent: Jul. 8, 2025

(54) VIBRATING BED

(71) Applicant: Thomas Staudacher, Geebung (AU)

(72) Inventor: Thomas Staudacher, Geebung (AU)

( * ) Notice: Subject to any disclaimer, the term of this patent is extended or adjusted under 35 U.S.C. 154(b) by 0 days.

(21) Appl. No.: 18/606,820

(22) Filed: Mar. 15, 2024

(65) Prior Publication Data

US 2024/0251956 A1 Aug. 1, 2024

Related U.S. Application Data

(63) Continuation of application No. PCT/AU2022/051111, filed on Sep. 15, 2022.

(51) Int. Cl.

*A47C 21/04* (2006.01)
*A47C 21/00* (2006.01)
*A47C 27/08* (2006.01)

(52) U.S. Cl.

CPC ..... *A47C 21/048* (2013.01); *A47C 21/006* (2013.01); *A47C 27/085* (2013.01)

(58) Field of Classification Search

CPC ... A47C 21/006; A47C 27/085; A47C 21/048; A61H 2201/0146; A61H 2201/0142; A61H 23/0236

See application file for complete search history.

(56) References Cited

U.S. PATENT DOCUMENTS 3,872,526 A * 3/1975 Betts ..... A47C 21/006 5/678
4,187,568 A * 2/1980 McMullan ..... A47C 21/006 601/78
4,757,548 A * 7/1988 Fenner, Jr. ..... H04R 1/02 5/666
5,027,453 A * 7/1991 Koenig ..... A47C 27/085 5/679
5,076,260 A * 12/1991 Komatsu ..... A61H 23/0236 601/56
5,175,898 A * 1/1993 Johenning ..... A47C 27/085 5/675
6,702,767 B1 3/2004 Douglas et al.
8,466,744 B2 * 6/2013 Salomie ..... H03F 3/45475 330/260

(Continued)

FOREIGN PATENT DOCUMENTS

GB 2513685 A * 11/2014 ..... A61M 21/00
WO 0067693 A1 11/2000

OTHER PUBLICATIONS

International Search Report and Written Opinion of the ISA/AU, mailed Oct. 13, 2022, in PCT Application No. PCT/AU2022/051111.

(Continued)

*Primary Examiner* — Justin C Mikowski
*Assistant Examiner* — Alison N Labarge

(57) ABSTRACT

Disclosed are embodiments of a vibrating bed which allows a particular person to induce a customized vibrational pattern that they find particularly therapeutic. In certain embodiments, the bed has a water mattress, a carriage for the mattress, a hardwood frame to support the carriage, a transducer for producing different vibrational patterns in the mattress, a vibrotactile amplifier for controlling the transducer, a computer for controlling the amplifier and software on the computer for producing sounds of particular frequencies to induce the vibrational patterns in the water mattress.

16 Claims, 3 Drawing Sheets

(56) References Cited

U.S. PATENT DOCUMENTS

| | | | | |
|---|---|---|---|---|
| 2012/0051579 | A1* | 3/2012 | Cohen | A61H 23/0236 381/388 |
| 2012/0203150 | A1* | 8/2012 | Eberhardt | A61H 1/005 601/55 |
| 2017/0239136 | A1* | 8/2017 | Reader | A61H 23/02 |
| 2020/0139870 | A1* | 5/2020 | Mergl | G06F 3/165 |

OTHER PUBLICATIONS

IP Australia, Examination Report No. 1, dated Nov. 23, 2023, in AU Application No. 2022352381.
IP Australia, Examination Report No. 2, dated Feb. 9, 2024, in AU Application No. 2022352381.
IP Australia, Notice of Acceptance, dated Feb. 22, 2024, in AU Application No. 2022352381.
Written Opinion of the IPEA/AU, mailed Apr. 13, 2023, in PCT Application No. PCT/AU2022/051111.

* cited by examiner

VIBRATING BED

CROSS REFERENCE TO RELATED APPLICATIONS

This application is a continuation of International Application No. PCT/AU2022/051111, filed Sep. 15, 2022, which claims priority to Australia application Ser. No. 2021903086, filed Sep. 26, 2021. The disclosures of which are hereby incorporated by reference for all purposes.

TECHNICAL FIELD

The present invention relates to the bed industry and, more particularly to a vibrating bed for inducing states of relaxation.

BACKGROUND

Many people suffer from pain, stress, disease and injuries which can be treated using relaxation. Complementary therapies can be used with traditional medicines to facilitate the body to heal itself. A person with a positive emotional state does not have as much stress hormones in their body, which can otherwise strain their immune system.

One form of complementary therapy can be provided by vibrating beds. However, currently available vibrating beds are not tuneable to treat certain conditions. They have generic vibration settings that are not adapted to a particular person's requirements. They provide generic vibration settings, rather than a customised setting producing a unique vibrational pattern for a particular person.

SUMMARY

According to a first aspect of the present invention there is provided a bed for inducing a plurality of unique vibrational patterns, the bed comprising:

(a) a mattress;
(b) a carriage for the mattress;
(c) a frame to support the carriage;
(d) a transducer for producing different vibrational patterns in the mattress;
(e) an amplifier for controlling the transducer;
(f) a computer for controlling the amplifier; and
(g) software on the computer for producing sounds of particular frequencies;

wherein the mattress is a water mattress.

Preferably, the frame is made of hard wood, but it may also be made of metal. The inventor has found that a hard wood called Tasmanian Oak is particularly effective at transmitting vibrations.

In preferred forms of the invention, the carriage comprises two connectable sections, which are interlocked when in use and separated when the bed is required to be transported.

Preferably, the amplifier is a vibrotactile amplifier.

The bed preferably includes a heater for the water mattress.

The frame preferably has an internal shelf to support the amplifier.

Preferably, the water mattress is filled to about 80% capacity in order to provide a comfortable level of support to the user and to permit the best propagation of vibrations to the body of the user.

Preferably, the feet of the frame should rest on carpet sections or on carpet flooring. This dampens the downward force of the vibrations to increase the vibrational resonance around the body of the user on the mattress.

According to another aspect of the invention there is provided a method of therapeutic treatment, the method comprising lying a person on a water mattress supported on a wooden carriage and frame with a transducer connected to, wherein the transducer is controlled by an amplifier through which sounds are produced to vibrate the water mattress in one or more specific harmonic modes most suited to induce relaxation in the person.

Any of the features described herein can be combined in any combination with any one or more of the other features described herein within the scope of the invention.

BRIEF DESCRIPTION OF DRAWINGS

Embodiments of the invention will be described with reference to the following drawings, in which.

DETAILED DESCRIPTION

Figure 1:
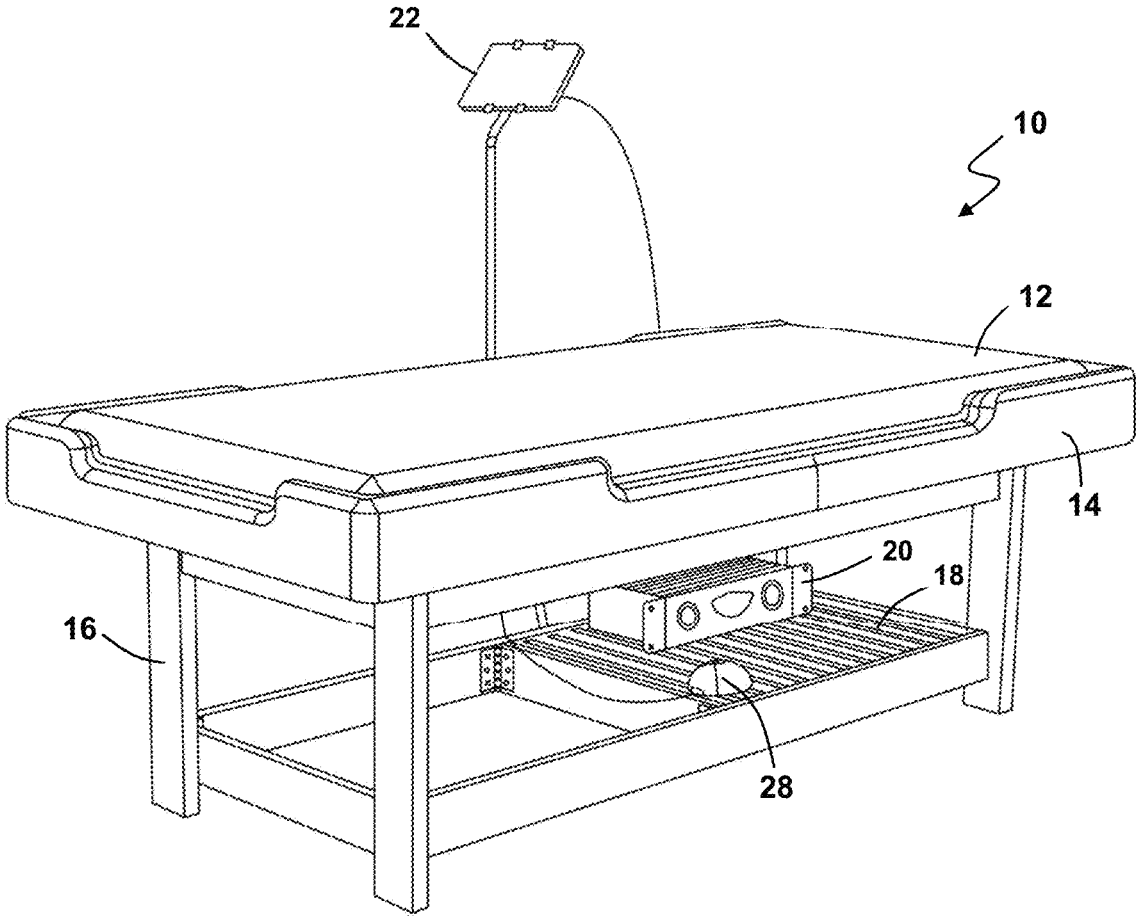
FIG. 1 is a perspective view of an assembled vibrating bed according to an embodiment of the present invention.

FIG. 1 shows a vibrating bed 10 according to a preferred embodiment of the present invention. The bed comprises a water mattress 12, which is supported in a carriage 14 that rests on a frame 16. The frame 16 is preferably made of hard wood (such as Tasmanian Oak) which is particularly effective at transmitting vibrations. The carriage has sections 17 and 19 which can be separated to compact the bed 10 for transport or storage.

The frame 16 has a shelf 18 that supports an amplifier 20 which is connected to a computer 22 to control a transducer 24 (see FIG. 2) which is screwed into the external underside of the base of the carriage 14. The computer 22 runs a software program capable of playing a suite of sound files that cause the transducer 24 to vibrate at different frequencies. The strength of the vibrations produced by the transducer 24 can be modulated by adjusting the volume of the sound file on the computer 22.

The transducer 24 is preferably a vibro-tactile speaker that does not pressurize the air around it like a traditional subwoofer speaker. Instead, it transmits low frequency sound energy into objects. The energy is delivered so cleanly through vibrotactile transfer that the person 26 lying on the bed 10 interprets the stimulus as sound, not shaking. The amplifier 20 is capable of producing vibrations from below 5 Hz to over 1000 Hz. Any 4-ohm stable amplifier that provides a minimum of 100 Watts Root Mean Square (RMS) power handling will be sufficient to power the transducer 24. Amplifiers with 150 to 300 Watts of power at 4-ohms impedance provide the best experience. The transducer 24 is thereby able to produce a strong vibration through the water in the mattress 12 without the volume being excessively high. The vibrations in the mattress 12 feel like background music to the person 26 lying on the bed 10.

Figure 2:
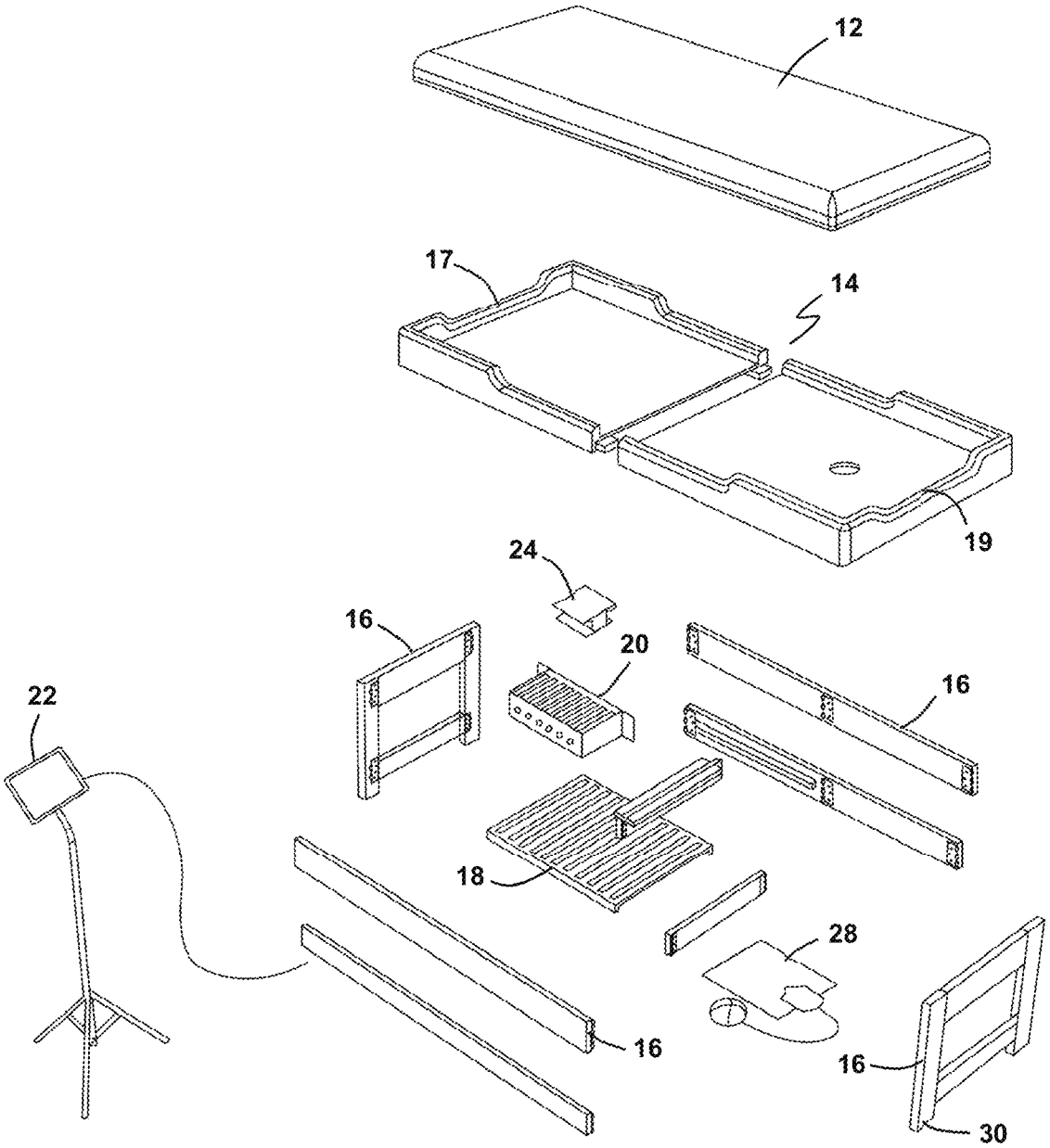
FIG. 2 is an exploded view of the vibrating bed of FIG. 1.

The bed 10 has a heater 28 for the water mattress 12 (see FIG. 2). Otherwise, the water mattress 12 can be too cold to be comfortable for a user to lie on it. The water mattress 12 should be filled to about 80% capacity in order to provide a comfortable level of support to the person 26 and to permit the best propagation of vibrations to the person 26.

The feet 30 of the frame 16 should rest on carpet sections attached thereto or on carpet flooring. This dampens the downward force of the vibrations and increase the vibrational resonance around the person 26 on the water mattress 12. The water in the mattress 12 is particularly effective at transmitting, amplifying and resonating the sound waves produced by the transducer 24. The water mattress 12 is also exceptionally comfortable to lie on as it molds to the body of the person 26.

Figure 3:
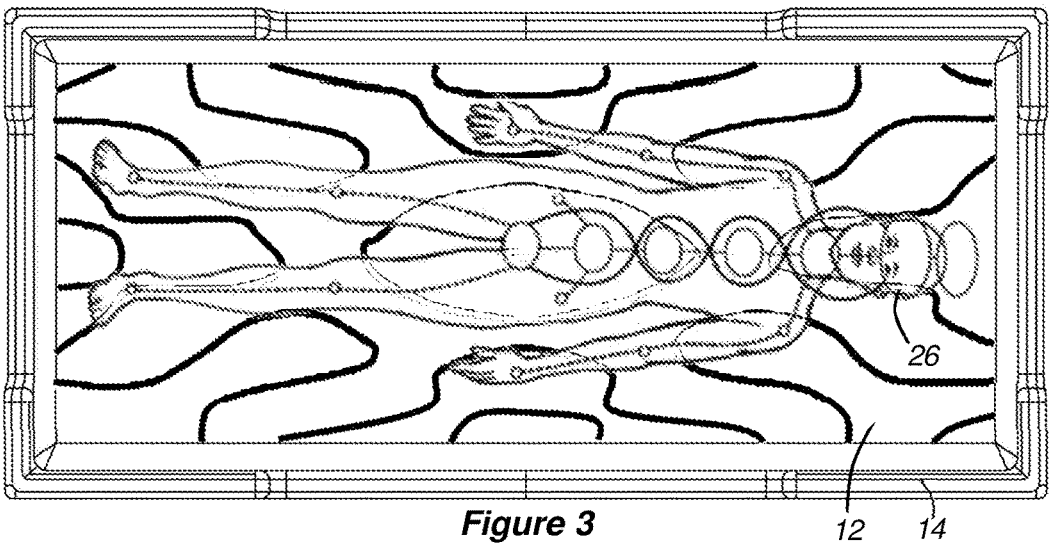
FIG. 3 is a top view of a first vibrational pattern produced by the bed for a first individual.
Figure 4:
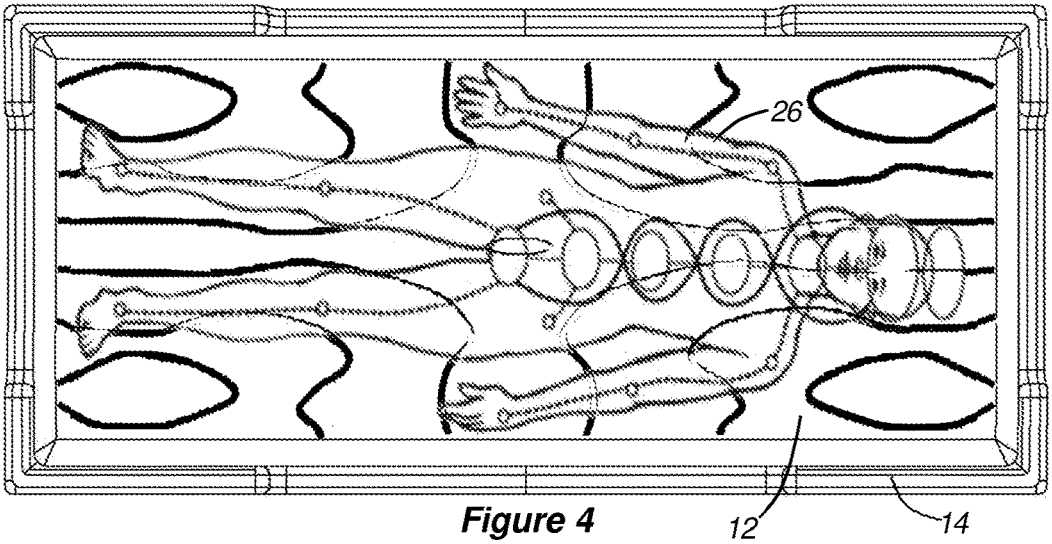
FIG. 4 is a top view of a second vibrational pattern produced by the bed for a second individual.
Figure 5:
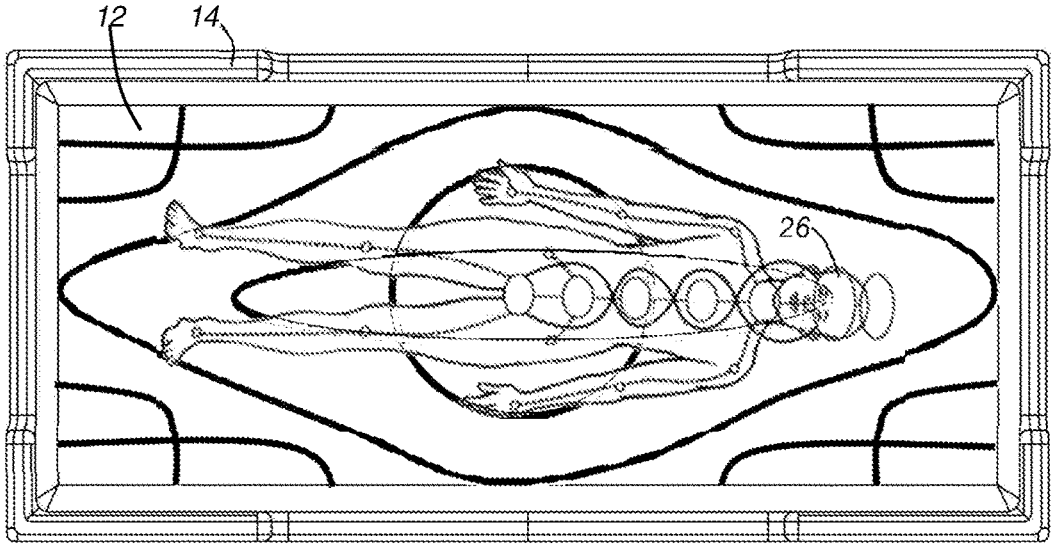
FIG. 5 is a top view of a third vibrational pattern produced by the bed for a third individual.

FIGS. 3, 4 and 5 show different vibrational patterns created by the transducer 24 operating at different frequencies on the carriage 14 of the bed 10. Different frequencies create different vibrational patterns. The vibrational patterns are created by regions of maximum and minimum displacement of the water in the mattress 12. The patterns change depending on the geometry of bed 10, different sound files on the computer 22 and the volume at which the sound files are played.

Different people have different bodies with different harmonic modes. Each individual will have a unique vibrational pattern which they find particularly therapeutic. That frequency may be their resonant frequency. If that particular frequency is applied, the body enters a deep state of relaxation which can activate the immune system. The activated immune system can deal with disease more effectively. It also encourages the person to excrete more toxins from their body. The present invention thereby facilitates the body to heal itself.

The body produces many sounds, such as the sound of our hearts beating, breath going in and out, joints clicking, stomach rumbling and throat vibrations when we speak or sing. However, the trillions of living cells that make up our bodies also vibrate at a minutely low frequency. In effect, cells constantly sing and their song changes in response to the environment, including pressure, temperature and their own inner processes. Their songs go out to their neighboring cells, announcing either health and harmony, or discord and illness of the tissue and organ they are part of. The neighboring cells hear each other's songs (that is, they transmit information) and are affected by and respond to each other. The word organ means both instrument or a body part. The singing of cells can be detected using atomic force microscopes. Overall, the singing of all the cells becomes an orchestra of your whole body. If an individual s health is bad, then the orchestra of cells are a cacophony. If a person's health is good, then the orchestra of their cells is in symphony. An object of the present invention is to make the cells harmonize.

The vibration-based relaxation induces a meditative state which bypasses the nerve tissue and aims solely at synaptic junctions in the nerves due to the piezoelectric effect created by the vibrations at the cellular level. This process allows the innate energetic communication network to access the information coming directly from the consciousness of the person.

In the present specification and claims (if any), the word 'comprising' and its derivates including 'comprises' and 'comprise' include each of the stated integers but does not exclude the inclusion of the one or more further integers.

Reference throughout this specification to 'one embodiment' or 'an embodiment' means that a particular feature, structure, or characteristic described in connection with the embodiment is included in at least one embodiment of the present invention. Thus, the appearance of the phrases 'in one embodiment' or 'in an embodiment' in various places throughout this specification are not necessarily all referring to the same embodiment. Furthermore, the particular features, structures, or characteristics may be combined in any suitable manner in one or more combinations.

The foregoing description of the embodiments of the invention has been presented for the purposes of illustration and description. It is not intended to be exhaustive or to limit the invention to the precise form disclosed. Many combinations, modifications and variations are possible in light of the above teaching. For instance, in certain embodiments, each of the above described components and features may be individually or sequentially combined with other components or features and still be within the scope of the present invention. Undescribed embodiments which have interchanged components are still within the scope of the present invention. It is intended that the scope of the invention be limited not by this detailed description, but rather by the claims.

The invention claimed is:

1. A bed for inducing a plurality of unique vibrational patterns, the bed comprising:

a water mattress configured to hold water and provide support;

a carriage supporting the water mattress, the carriage comprising separable sections for transportation or storage;

a frame supporting the carriage, wherein the frame is made of hard wood effective at transmitting vibrations;

a vibro-tactile amplifier positioned in the frame;

a computer connected to the vibro-tactile amplifier, configured to run software for playing sound files;

a transducer, controlled by the computer and driven by the vibro-tactile amplifier, fastened to the underside of the carriage, for transmitting low frequency sound energy into the water mattress, wherein the transducer is a vibro-tactile speaker that transmits sound energy as vibrations perceived as sound by a person positioned on the bed;

wherein the vibro-tactile amplifier is configured to produce vibrations between 5 Hz and 1000 Hz, with a 4-ohm impedance and minimum 100 Watts RMS power handling.

2. The bed of claim 1, wherein the bed includes a heater for the water mattress.

3. The bed of claim 1, wherein the frame has an internal shelf to support the amplifier.

4. The bed of claim 1, wherein the water mattress is filled to about 80% capacity.

5. The bed of claim 1, wherein the feet of the frame rest on carpet or attached carpet sections to dampen vibrations and increase vibrational resonance.

6. The bed of claim 1, wherein the vibro-tactile amplifier is configured to provide between 150 to 300 Watts of power at 4-ohms impedance for optimal vibrational experience to the user.

7. The bed of claim 1, further comprising a modulator for adjusting the strength of the vibrations produced by the vibro-tactile speaker, wherein the modulator is a volume control feature of the software program.

8. A method for producing a vibrational relaxation comprising:

positioning a water mattress on a carriage;

filling the water mattress to approximately eighty percent of capacity;

heating the water in the water mattress;

positioning a user on the water mattress;

sending energy from a vibrotactile amplifier to a vibrotactile speaker positioned under the carriage to cause the speaker to vibrate at different frequencies;

transmitting low frequency sound energy from the vibrotactile speaker positioned below the carriage to produce a vibration through the water in the mattress which appears to the user to have the same intensity of background music, and modulating the strength of the vibrations cause by the transducer to induce a state of relaxation within the user.

9. The method of claim 8, further comprising producing a vibrational pattern that corresponds to the user's resonant frequency.

10. The method of claim 8, further comprising changing the vibrational pattern by varying the song files played and the volume that the songs files are played.

11. The method of claim 8, further comprising producing vibrational patterns by creating regions of maximum and minimum displacement of the water in the mattress.

12. The method of claim 8, further comprising dampening a downward force of the vibrations thereby increasing the vibrational resonance around the user.

13. The method of claim 8, further comprising producing a strong vibration through the water in the mattress without pressurizing air.

14. The method of claim 8, further comprising producing vibrations between 5 Hz to 1000 Hz.

15. The method of claim 8, further comprising playing a plurality of sound files on a computer electronically coupled to the vibrotactile amplifier.

16. The method of claim 8, wherein the modulating step includes adjusting the volume of a sound file playing on a computer.

* * * * *